United States Patent [19]

Summers et al.

[11] Patent Number: 4,921,047

[45] Date of Patent: May 1, 1990

[54] COMPOSITION AND METHOD FOR SEALING PERMEABLE SUBTERRANEAN FORMATIONS

[75] Inventors: Laine E. Summers, Katy, Tex.; Jeff J. Jurinak, Ponca City, Okla.

[73] Assignee: Conoco Inc., Ponca City, Okla.

[21] Appl. No.: 392,180

[22] Filed: Aug. 10, 1989

[51] Int. Cl.[5] ..... E21B 33/138; E21B 43/04

[52] U.S. Cl. ..... 166/276; 166/295; 166/300; 405/264; 523/130

[58] Field of Search ..... 166/164, 276, 278, 295, 166/300; 523/130, 132; 405/264, 266, 267

[56] References Cited

U.S. PATENT DOCUMENTS

| | | | |
|---|---|---|---|
| 2,904,530 | 9/1959 | Steckler et al. . | |
| 3,023,190 | 2/1962 | Damusis . | |
| 3,759,914 | 9/1973 | Simms et al. . | |
| 4,042,031 | 8/1977 | Knapp | 166/295 X |
| 4,072,194 | 2/1978 | Cole et al. | 166/295 |
| 4,074,760 | 2/1978 | Copeland et al. | 166/276 |
| 4,465,542 | 8/1984 | Furihata | 156/330 |
| 4,665,988 | 5/1987 | Murphey et al. | 405/264 X |

*Primary Examiner*—George A. Suchfield

[57] ABSTRACT

A mixture of an epoxy material and two hardeners is placed in a subsurface zone in which it is desired to form an impermeable zone, and the epoxy is thereafter allowed to harden. The epoxy material and hardeners are characterized inthat: (1) each hardener has a different activation temperature; (2) the amount of each hardener in the mixture is less than that required to totally react the epoxy material; (3) the epoxy material has a low viscosity at subsurface conditions of temperature and pressure; (4) the epoxy material is substantially immiscible with any fluids which are present in the subsurface area; and (5) the hardening time of the epoxy material is of short duration at subsurface conditions of temperature and pressure.

9 Claims, 5 Drawing Sheets

COMPOSITION AND METHOD FOR SEALING PERMEABLE SUBTERRANEAN FORMATIONS

BACKGROUND OF THE INVENTION

Epoxy resins and cements are used in a variety of oil field applications, which include primary cementing, casing repair, and water control. Epoxy materials may also be used for cementing wells which are employed to dispose of liquid wastes. An operation of this type is disclosed in U.S. Pat. No. 4,072,194. Epoxys may also be used in the leaching of minerals from subterranean formations to repair leakage through short-circuit passages formed between adjacent injection and production wells. Such a use is disclosed in U.S Pat. No. 4,438,976. Epoxy systems have high compressive strengths and excellent resistance to chemical and thermal degradation. Therefore, epoxys are well suited for the hostile conditions often encountered in subterranean formations.

In most applications, the epoxy formulations are based on the cured or final resin property requirements. To meet these objectives, hardeners may be used to accelerate curing once the resin is set and to optimize the resin properties. However, the placement of the epoxy in the subterranean formation is the critical and limiting step to the effective use of these systems in such formations.

Techniques for the placement of epoxy materials into subter, ranean formations; e.g., a casing annulus a gravel pack completion, or formations of the types described in U.S. Pat. Nos. 4,072,194 and 4,438,976, have been disclosed in numerous publications. All of these methods require that the epoxy material remain as a low viscosity fluid prior to and during the placement. Once in place, the epoxy must rapidly harden to form a rigid thermoset solid.

The principal manner of controlling the liquid epoxy viscosity and the hardening time of the epoxy is the selection of a hardener that is thermally activated. The increase in epoxy temperature caused by the thermal gradient in the well initiates the epoxy reaction once the activation or onset temperature of the hardener is exceeded. While variation in the hardener concentration provides a limited control of the set time, the amount of hardener used must be kept in a relatively narrow range for the resin to cure properly. With insufficient hardener, long set times result, incomplete reaction occurs, and resins remain uncured, If the amount of hardener is too great, the set time is too short to allow proper placement of the epoxy material. Also, with excessive amounts of hardener, the energy of the exothermic epoxy reaction is released very quickly. When this quick release of energy is coupled with the mass of resin required for many well operations, the energy released may produce extremely high temperatures in the resin. which can thermally decompose a portion of the epoxy material or damage underground equipment.

PRIOR ART

U.S. Pat. No. 4,072,194 to Cole et al. discloses the use of epoxy resins for completing wellbores used for waste disposal, in combination with a hardener which cures the resin after a latent period. and an accelerator The hardener is preferably present in a concentration less than the stoichiometric concentration to increase the latent period, U.S. Pat. No. 2,904,530 to Steckler et al. discloses curing epoxy resins with a mixture of two aromatic polyamine hardeners.

U.S. Pat. No 3.759,914 to Simins et al. discloses compositions containing epoxy resin, a latent amine curing agent, and an accelerator. It is stated that an effective amount of the latent amine curing agent should be used to cure the epoxy material and that often, this effective amount will be the stoichiometric amount.

U.S Pat. No. 4,074,760 to Copeland et al. discloses resin containing composition for consolidating gravel packs containing a particulate material, an epoxy resin solvent mixture, a curing agent a coupling agent, an aqueous carrier fluid, and a surfactant. The curing agents may be mixtures of various amines. It is stated that the particular curing agent used and its concentration can easily be determined by a knowledge of temperature conditions and available working time.

U.S. Pat. No. 3,023,190 to Damusis describes a chemical curing of polyepoxy.polyhydroxy ether resins with a mixture of a catalyzing curing amine and a reacting curing amine. The reacting curing amines are primary amines and in certain cases, secondary amines. The catalyzing curing amines are tertiary amines.

U.S. Pat. No. 4,465,542 to Furihata relates to an adhesive composition including epoxy resins and corsercially available hardeners, Curing accelerators can be used together with the hardeners.

SUMMARY OF THE INVENTION

In accordance with this invention, a composition for use in a subsurface area is provided which comprises a liquid epoxy material and two hardeners for the epoxy material, each of which has a different activation temperature. The composition is further characterized in that the amount of each hardener in the composition is less than that required to totally react with the epoxy material, the epoxy material has a low viscosity at subsurface conditions of temperature and pressure, the epoxy material is substantially immsiscible with any fluids in the subsurface area, and the hardening time of the epoxy material is of short duration at subsurface conditions of temperature and pressure.

The composition of the invention is particularly useful in oil field applications and, more particularly, in gravel-packed completions. When used in such completions, the composition is further characterized in that the density of the epoxy material is greater than the density of the well fluid and the mixture of the epoxy material and hardener is essentially free of solids.

DETAILED DESCRIPTION OF THE INVENTION

In carrying out the process of the invention, a composition comprising a mixture of an epoxy material and two hardeners for the epoxy material is delivered adjacent to a zone which is to be treated and the mixture is thereafter displaced into the zone and allowed to harden. The compositions and process of the invention find application in a variety of uses, including those mentioned previously in the background discussion. The invention, however, is particularly applicable to oil and gas wells containing gravel packs where water encroachment has led to advancement of water into the producing interval so that the well produces larger and larger quantities of water over a period of time. By plugging off the water zone, it is possible to reduce or even eliminate the flow of water, thus restoring the desired production of oil and/or gas from the well For convenience, the invention will be described in its specific application to a gravel-packed well.

Figure 1:
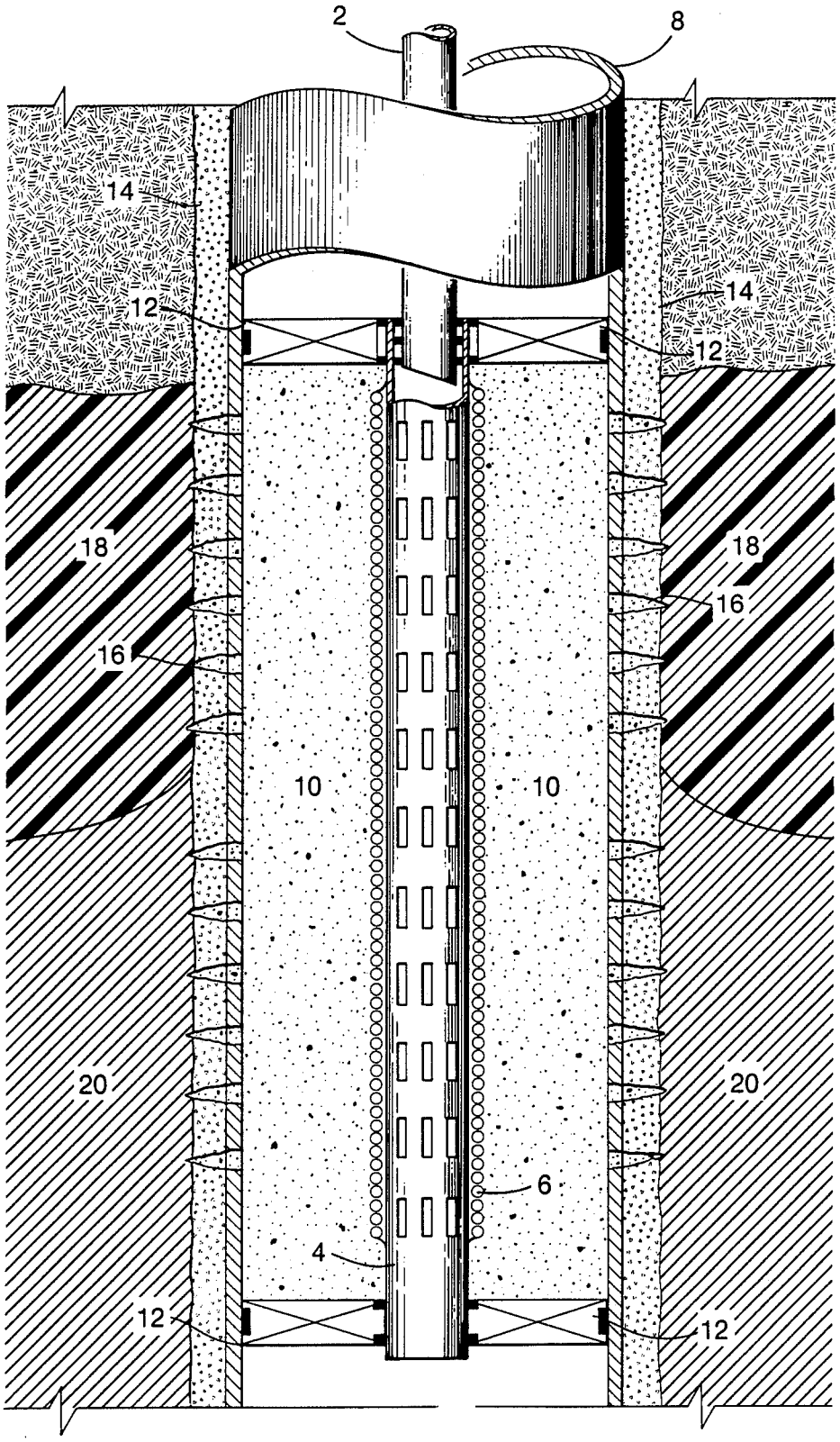
FIG. 1 is a sectional view of a typical wellbore containing a gravel pack.

The process of plugging off a water formation in such a well may be described by reference to the drawings. Referring to FIG. 1. there is disclosed a subterranean oil or gas zone and a water zone at 18 and 20, respectively. Although these are shown as separate zones, they may not be distinct and separate from each other but may tend to merge one zone into the other. Traversing these zones is a producing well having an outer production casing 8 and inner production tubing 2. A portion of the well adjacent zones 18 and 20 is isolated from the remainder of the well by upper packer 12. which is placed between tubing 2 and casing 8, and a lower packer 12 which is placed between slotted tubing 4 and casing 8 Contained in this isolated area is a slotted tubing 4, which is somewhat larger in diameter than production tubing 2. Around the outside of slotted tubing 4 is a wire.wrapped screen 6 which is supported and spaced from the slotted tubing by vertical rods (not shown). The isolated section of casing 8, which surrounds slotted tubing (4) and wire screen 6 is filled with gravel 10. This gravel fills not only the casing but also the perforations 16 extending from the casing through the primary cement 14 around the casing and into formations 18 and 20.

It is desirable that the well remain dormant during the operation of the procsss. If the well does not remain dormant, downhole fluid movement, or "cross-flow," between sand beds within the completion interval may cause the epoxy to be dispersed into portions of the well which do not require plugging. Also, the epoxy plug can become "honey-combed" if gas continues to trickle into the wellbore before the epoxy is completely hardened. If the well is not dormant, that is if there is gas flow, it may be eliminated or minimized by filling the well with fluid and maintaining a positive pressure; e.g., from about 300 to about 500 psi at the surface of the well. The fluid used may be fresh water, formation brine, seawater, or any other formation.compatible material. The first step of the process, therefore, if the well is not dormant, is to maintain a positive pressure at the surface of the well to ensure that the well remains essentially full of fluid. When the near wellbore area is sufficiently saturated with the displacement fluid, the migration of oil or gas into the wellbore is minimized.

In the next step of the process, the liquid epoxy material and hardeners are mixed together to form a liquid mixture and are introduced into the well and placed at a point adjacent to gravel-packed zone (10). Since the temperature in the well gradually increases from the top of the well down to the formation to be plugged, it is desirable to place the mixture of epoxy material and hardeners at the point of use as quickly as possible, thus ensuring that the epoxy material does not begin to harden until it is placed in the area of the zone which is to be plugged.

One method for moving the mixture of epoxy material and hardener to the desired location is to use a positive displacement dump bailer. This is a known mechanical device cylindrical in shape, which is filled with the mixture of epoxy material and hardeners and lowered into the well on a cable. The bailer is positioned at the desired depth and when activated, releases a metal bar in the top of the device. The bar falls downward inside the device and impacts the top of the fluid creating a downward-moving shock wave which travels through the fluid column contained by the bailer. The shock wave causes the shearing of metal pins in the bottom of the bailer and subsequent downward movement of a small piston which uncovers ports to allow the release of the contained material. The metal bar continues to fall through the bailer as fluid is released through the ports. The weight of the metal bar effectively adds to the weight of the fluid column being dumped. As the bar falls to the bottom of the bailer, the cylindrical bailer tube is wiped clean of the epoxy material/hardeners mixture.

Other types of positive displacement dump bailers, which operate in a similar manner, may also be used. It is also possible to deliver the mixture of epoxy material and hardener in an open bailer. This is a bailer which is open at the top and closed at the bottom. When activated, the bottom cover, which is held by metal pins, is sheared by an explosive or by other means thereby opening the bottom and allowing the mixture of epoxy material and hardener to flow by gravity from the bottom of the bailer and into the formation.

A coiled tubing may also be used to place the mixture at the desired point in the well. The coiled tubing is a 1-inch or other small pipe which is wound on a spool at the surface of the well. The mixture of epoxy material and hardener is placed in the end of the tubing and held in place by wiper balls at the top and at the bottom of the mixture. The tubing is then uncoiled and lowered into the well to the desired location, after which the mixture of epoxy material and hardener is pressured through the tubing and released at the selected location.

Referring again to FIG. 1, whatever apparatus is used for the purpose, the mixture of epoxy material and hardeners is placed in the apparatus and is delivered as quickly as possible to a point slightly above water zone (20). The apparatus is then activated to release the epoxy material/hardeners mixture which flows into slotted tube (4) and from there into the gravel pack (10) and perforations (16) At this point, a small amount of liquid may be pumped slowly into production tubing (2) to "squeeze" the epoxy material into the pore spaces of the formation rock or any voids in the primary cement (14) around the production casing. As the temperature of the mixture of epoxy materials and hardeners begins to approach the existing downhole temperature, the hardener with the lower activation temperature is activated and the epoxy material begins to react and increase in viscosity. As the temperature of the epoxy material increases still further, the second hardener reaches its activation temperature and the epoxy material continues to react. Eventually the epoxy material is completely reacted or cured.

Figure 2:
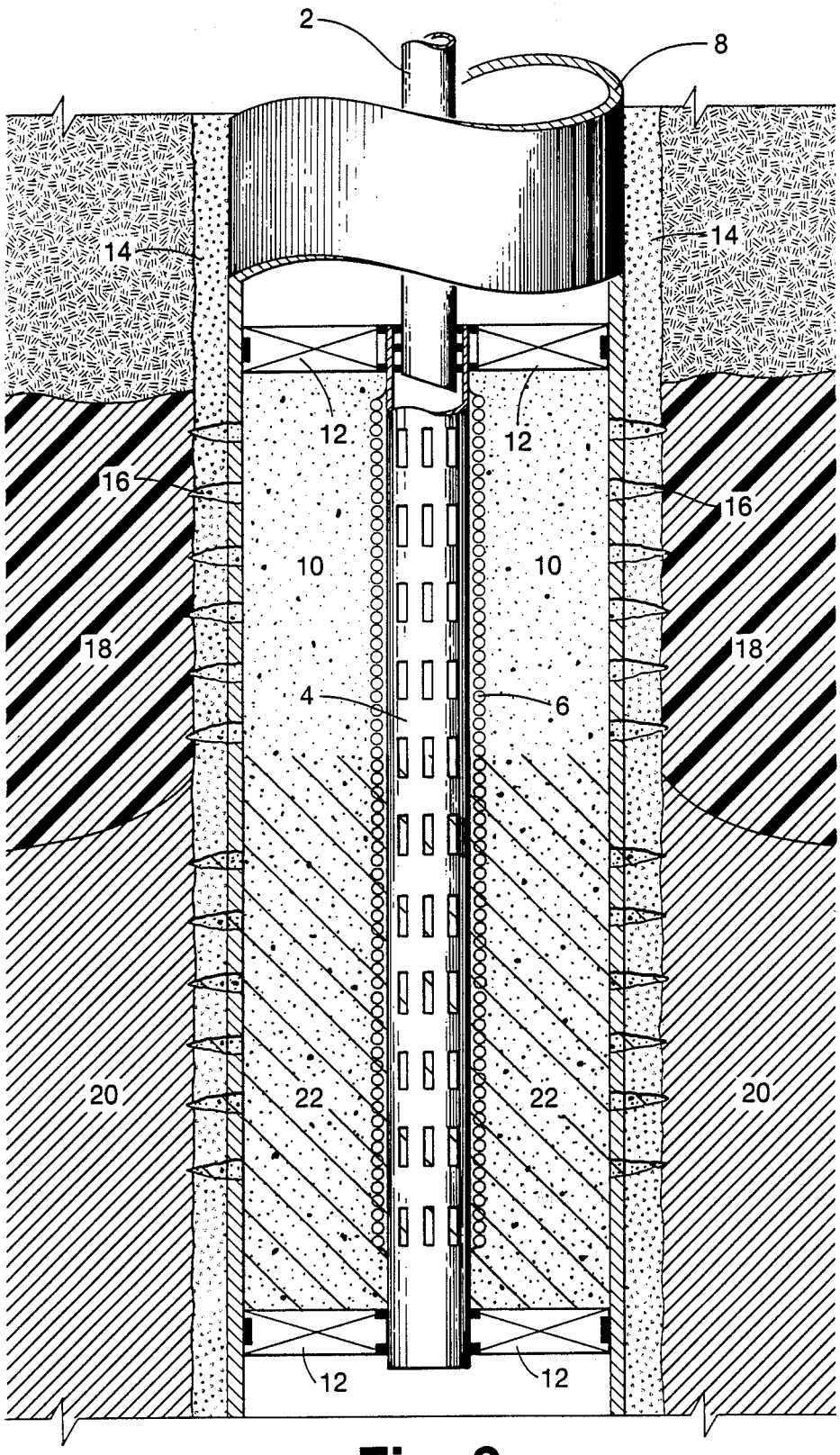
FIG. 2 is a sectional view of the same wellbore after treatment with the composition of the invention.

FIG. 2 shows the same well as FIG. 1 after the epoxy material has hardened to form a solid plug (22) adjacent water zone (20). This plug fills the slotted pipe, the screen, the gravel, and may even enter the perforations

(16) to effectively plug off production of water from zone (20).

The epoxy materials used in carrying out the invention have densities greater than the well fluid, which as previously pointed out may be fresh water, formation water, or other water containing salts. The epoxy materials are also essentially immiscible with the well fluid These two properties assure that the epoxy/hardeners mixture will not tend to rise through the formation fluid, nor will the mixture be diluted in any way by the formation fluid so as to prevent the epoxy from performing its proper function. Preferably, the epoxy will have a density of at least about 1 to about 1½ pounds per gallon greater than the wellbore fluid.

The epoxy materials used will further have a relatively low viscosity at downhole conditions of temperature and pressure Thus the fluidity of the epoxy material and the density difference between the epoxy material and the wellbore fluid will facilitate the almost com. plete displacement of the wellbore fluid, saturating the gravel-pack in the zone to be treated. The viscosity of the epoxy material is usually between about 500 and about 1 centipoise at downhole temperatures of between about 75 and about 220 degrees Fahrenheit. The epoxy materials used are also essentially free of solids and, therefore, contain no materials to plate out on the gravel-packed sand face as does cement.

The epoxy material goes through several physical stages in the process of the invention. In the first stage, it is a flowable liquid of relatively low viscosity, particularly at higher temperatures. When the temperature of the epoxy material reaches the activation temperature of the hardener with the lower activation temperature, it begins to react and increase in temperature and viscosity. The hardener with the higher activation temperature then comes into play to cause further reaction of the epoxy material. Eventually the epoxy material hardens sufficiently that it ceases to flow. The point at which this occurs is called the "set point.". With additional time, the epoxy material continues to react and increase in viscosity until it becomes a solid. At this point, the epoxy is considered to be "hardened." The time required after the temperature reaches the set point for the epoxy material to become hardened is normally of very short duration—usually from between about 2 to about 20 minutes. With still additional time the epoxy material becomes completely reacted and harder and is considered to be cured. As with concrete, this final curing stage may take as much as several days, depending on the particular epoxy material/hardeners system.

In the application of the process of the invention, variation of the total combined hardener concentration in the epoxy material and the ratio of the hardeners is used to control the epoxy material viscosity and its set time over a wide range of conditions. As the epoxy material temperature is increased, the first hardener initiates a partial reaction of the epoxy material. This may produce a slight to moderate viscosity rise in the epoxy material. The change in viscosity can then be tailored to the specific application by varying the ratio of the hardeners. Once the epoxy material is in place and is at the treatment zone temperature, the second hardener initiates to complete reaction of the epoxy material. With additional curing at the treatment temperature, the strength of the solid epoxy material increases.

The set time of the epoxy material/hardeners mixture should be of short duration. Ideally, the epoxy material would begin to harden immediately after the mixture of epoxy material and hardeners have had a chance to completely displace the wellbore fluid in the area to be treated. Delayed hardening is desirable for two reasons. First, if the well does not remain entirely dormant from the time the epoxy material is placed until it is hardened, downhole fluid movement or cross-flow between sand beds within the treated area may cause the epoxy material to disperse into lower or upper portions of the well. Secondly, if the epoxy material remains in an ruihardened state, or if the reaction requires an extended period of time to complete, the integrity of the plug can be reduced if gas continues to trickle into the wellbore before the epoxy material is hardened. By proper selection of the epoxy material and hardeners, set times for the epoxy material can be designed to vary between several minutes to more than an hour. The set time of the epoxy material will be between about 1 and about 180 minutes and preferably between about 10 and about 60 minutes at bottom-hole conditions.

The amount of epoxy material used to plug off a interval depends on the size of the gravel packing and the portion of the gravel pack which it is desired to plug. Usually an amount of epoxy material between about 0.5 and about 2.0 gallons per foot of plugged interval is sufficient. Since the amount of epoxy material which a bailer or coiled tubing can deliver in a single operation is limited, it may be necessary to carry out the delivery process in two or more stages.

The hardener materials used in the process are those which are compatible with the epoxy material in that once the two are mixed, they form a liquid mixture which is substantially free from solids. Both hardeners employed in admixture with the epoxy materials have activation temperatures which are below the anticipated temperature in the treatment zone. Activation temperatures of hardeners can be accurately measured in calorimetry studies. Usually the hardener activation temperatures, as determined from calorimeter runs, will not be more than about 20° F. to about 30° F. below the temperature in the treatment zone. The hardener which is used for viscosity control has a lower activation temperature than the other hardener which determines the ultimate set time of the epoxy material. The amount of each of the two hardeners used in the compositions of the invention is less than that required to completely react with the epoxy material; however, the combination of the hardeners is sufficient to provide complete reaction and curing.

The total amount of the two hardeners used in the epoxy compositions usually is between about 2 and 15 parts per 100 parts of the epoxy material. The amount of each individual hardener used will vary from between about 1 to about 10 parts per 100 parts of the epoxy material. All parts herein are parts by weight.

Any epoxy material which meets the criteria previously set forth may be used in carrying out the process of the invention. A widely used class of polyepoxides from which the epoxy material may be selected are the resinous epoxy polyethers obtained by reacting an epihalohydrin, such as epichlorohydrin, epibromohydrin, epiiodilydrin, and the like with either a polyhydric phenol or polyhydric alcohol. The resulting resinous products may contain free terminal hydroxyl groups or terminal hydroxy groups and terminal epoxy groups.

Another class of polymeric polyepoxides from which the epoxy material may be selected are the polyepoxy polyhydroxy polyethers obtained by reacting a polyhydric phenol, such as bisphenol A, resorcinol, catechol, and the like, or a polyhydric alcohol such as glycenol, sorbitol, pentaerythritol and the like with a polyepoxide such as bis(2,3-epoxypropyl) ether, bis(2,3-epoxy-2-methylpropyl) ether, 1,2-epoxy-4,5 epoxypentane, and the like.

Another class of epoxides are the novolac resins obtained by reacting, in the presence of a basic catalyst, an epihalohydrin, such as epichlorohydrin, with the resinous condensate of an aldehyde; e.g . formaldehyde, and either a monohydric phenol; e.g., phenol itself, or a polyhydric phenol; e.g., bisphenol A.

Still another class of epoxides are the homopolymers and copolymers of epoxy containing monomers which also contain at least one double bond. Among such ethylenically unsaturated epoxy-containing monomers are vinyl 2,3-glycidyl ether, allyl 2,3-glycidyl ether, glycidyl acrylate, 2,3-epoxypropyl crotonate, glycidyloxystyrene, and the like. Suitable comonomers for copolysrization with these ethylenically unsaturated epoxy containing monomers include styrene, acrylonitrile, methyl acrylate, vinyl chloride vinyl acetate, diallyl phthalate, and the like.

Yet another class of epoxides are the di- and tri-epoxides, such as 3,4-epoxycyclohexylmethyl, 3,4-epoxycyclohexene-carboxylate. 3,4-epoxy,6-methylcyclohexylmethyl-3,4-epoxy-6-methyl cyclohexane carboxylate, bis(3,4-epoxy-cyclohexylmethyl) maleate, bis(3,4-epoxy-6-methylcylohexyl) methyl-succinate, ethylene glycol bis(3,4-epoxycyclohexane) carboxylate 2 ethyl-1,3-hexanediol bis(3,4-epoxy-6-methylcyclohexane carboxylate, and the like.

Another type of epoxides are the glycidyl ethers of alcohols and phenols, including such compounds as the diglycidyl or triglycidyl ethers of trimethyl propane, the diglicidyl ethers of 1,4 butanediol. 1,6 hexanediol, neopentylglycol resorcinol, hydroquinone, catechol, bis (hydroxyphenyl) methane, and the like.

Other monomeric polyepoxides which may be used include dicyclopentadiene dioxide, epoxidized triglycerides such as epoxidized glycerol trioleate, epoxidized glycerol trilinoleate, the diacetate of epoxidized glycerol trilinoleate and the like, 1,8-bis(2,3-epoxypropoxy)octane, 1,4-bis(2,3-epoxypropoxy) cyclohexane, 1,4-bis(3,4-epoxybutoxy)-2-chlorocy-clohexane, 1,3-bis(2,3-epoxypropoxy)benzene, 1,4-bis (2,3-epoxypropoxy)benzene, 1,3-bis(2-hydroxy,3,4-epoxybutoxy)benzene, 1,3-bis(4,5-epoxypentoxy),5-chlorobenzene, 4,4'bis(2,3-epoxypropoxy) diphenyl ether, and epoxy ethers of polybasic acids such as diglycidyl succinate, diglycidyl adipate, diglycidyl maleate, diglycidyl phthalate, diglycidyl hexachloroendomethylenetetrahydrophthalate, and diglycidyl 4,4'-isopropylidenedibenzoate, and the like.

It will be appreciated by those skilled in the art that the epoxides used in carrying out the invention are not limited to those selected from the above-described materials, but that said epoxides are merely representative of the class of epoxides as a whole.

The hardeners which are used in carrying out the process of the invention may be either liquids or solids. If present in the solid state, they may be melted and combined with the liquid epoxy material. or they may be dispersed in a solvent, or they may be converted to fine solids; e.g., by grinding, and then combined with the epoxy. In any event, the final mixture of epoxy material and hardener is a liquid and when used in packed completions, is characterized as being substantially free of solids.

Any hardener which has an activation temperature lower than the formation temperature at the zone to be plugged may be used. Examples of hardening agents are aliphatic and aromatic polyamines, acid anhydrides, the hydrazides derived from polycarboxylic acids, imidazole derivatives, dicyanodiamide, guanidine derivatives, and biguanidine derivatives. Typical examples of those hardeners are diaminodicylo methane, bis(4,amino,3-,methylcyclohexyl) methane, diaminodiphenyl, methane, diaminodiphenyl,sulfone, 4,4'diamino-3,3'-dichlorodihexyl, methane, phthalic anlydride, chlorendic acid, and the like, Hardeners which may be used also include primary and secondary polyamines, such as diethylene triamine, triethylene tetramine, tetraethylene pentamine, aminoethyl ethanolamine, hydrazine, ethylene diamine, 1,3,propanediamine, 1,4,butane diamine, 1,6-hexane-diamine 3,3'-imino,bispropylamine, 1,2-propane diamine, 1,5-pentane diamine, phenylene diamine, and tertiary amines characterized by the formula:

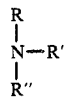

Wherein R, R', and R'' are the same or different organic radicals such as dimethylethanolamine, dimethylpropylamine, dimethylbutylamine, dimethyloctylamine, dimethylethylamine, mono.methyl.diethylamine, diethylethanolamine, dimethyl decyl amine, monomethyl ethyl butyl amine, monomethyl dibutyl amine, monomethyl diprophyl amine, NN-dimethyl amino butyl amine, NN-dimethyl-amino hexyl amine, NN-diethyl amino butylamine, tetramethyl ethylene diamine, tri-methyl ethylene diamine, tetramethyl propylene diamine, tetraethyl ethylene diamine, triethyl ethylene diamine, tetraethyl propylene diamine, NN-diethylamino ethylamine, dimethylamino-propylamine, diethylamino-propylamine, dimethylaminomethyl phenol, and tri-(dimethyl-aminomethyl) phenol.

Other hardeners which may be used. some of which fall under the above classes of materials, are dicyanamide, thioameline, sodium phenylcyanamide, dithiobiurel, ethylenethiourea, dialkylmelamine, acetoguanamine, melamine, guarylurea, benzoguanamine, benzoyldicyandiamide, guanazole, 3-aminio-1,2,4 triazole, monomethyloldicyandiamide, thiosemicarbazide, adipamide, adipyl dihydrazide, isophthalyl diamide, isophthalyl dihydrazide, trisinomelamine, tetraminoditolylmethane, diamioacridine, phenylbiguanide, semicarbazide, 2oxoimidazoline-4.5-diacarboxamide, oxaldiimidic acid dyhydrazid, oxamidedioxime, diaminomaleonitrile, 2,3-diamino-5,6-dicyanopyrazine, stearic hydrazide, succiminide, and cyamoacetimide.

Still other hardeners include such materials as boron trifluoride-organic amine adducts; e.g., boron trifluoride amine complex, containing p-chloromiline and triethylene glycol.

The foregoing materials are not limiting; any hardener may be used which meets the previously described general requirements.

The use of multiple hardener systems with epoxy materials in oil field applications offers a number of advantages over the use of a single hardener. For example, varying the ratio of the hardeners allows viscosity control of the epoxy material that cannot be achieved with a single hardener. Increasing the concentration of the hardener with the lower activation temperature has the effect of viscosifying the epoxy fluid early in the placement process. This may be desirable in some applications to improve displacement of reservoir fluids or prevent overdisplacement of the epoxy material. Decreasing the concentration of the lower activation temperature hardener allows the epoxy material to remain a low-viscosity fluid for a longer period of time. Thus, additional flow time or reservoir penetration is achieved.

The use of multiple hardeners provides greater control of the hardening time of the epoxy material than single hardener systems. As with single hardeners, the hardening time can be varied by changing the combined hardener concentration. However, in dual hardener systems, a proportional increase in the higher activation temperature hardener produces further changes in hardening time. The transition from a low viscosity epoxy material to a solid material may be very rapid or can be delayed with multiple hardeners.

With a single hardener. concentrations below the hardener level required to completely react the epoxy material may be required in some applications in order to produce adequate flow or hardener times Undercured epoxy materials are susceptible to degradation and premature failure downhole However. with dual hardener systems, formulations with adequate flow and hardening times can be used that still produce completely reacted and more resistant epoxy materials.

Once the activation temperature of a single hardener has been exceeded, the reaction is initiated. Often the energy from the reaction is released very quickly, and the epoxy material in the wellbore heats up. If the hardener is in excess or if the effect of wellbore pressure accelerates the reaction, the temperature rise caused by the exothermic reaction may be uncontrolled and could degrade the epoxy material or damage the treated interval With multiple hardener systems, the energy evolved in the reaction is unchanged. but the rate at which it is released is significantly altered. The exothermic temperature rise can be controlled because the hardeners activate at different times. Thus. the heat evolved when the first hardener initiates reaction can be partially dissipated before the second hardener initiates further reaction of the epoxy material.

The following examples illustrate the results obtained in carrying out the invention:

EXAMPLE 1

An epoxy material, Heloxy-69, and two hardeners, Ancamine K-61-B and Curezol 2E4MZ-CN, were used in the following tests. Heloxy.69 is a resorcinol diglycidyl ether manufactured by Wilmington Chemical Corporation of Wilmington, Del. Ancamine K-61-B is a tertiary amine marketed by pacific-Anchor Chemical Company of Los Angeles, Calif. and Curezol 2E4MZ-CN is an imidazole compound manafactured by Shikoku Chemicals Corporation.

Tests were conducted that evaluated the flow time, the set time, and the exothermic temperature rise of several formulations at 190° F. Samples were prepared by weighing various combinations of hardeners and Heloxy-69 epoxy material on an analytical balance. Small samples of each formulation were then transferred into glass bottles and were placed in an oil bath. In addition, larger samples. 10 to 15 grams, were weighed into Nalgene bottles, a thermocouple was inserted into the epoxy fluid, and the samples were placed in the oil bath. The temperature of the oil bath was ramped from 85° F. to 190° F. in one hour to simulate the thermal gradient the epoxy would follow in a wellbore. Once at 190° F., the viscosity of the small epoxy samples was checked visually at five-minute intervals.

The temperatures of the oil bath and the epoxy samples in Nalgene bottles were measured and recorded every 30 seconds.

Figure 4:
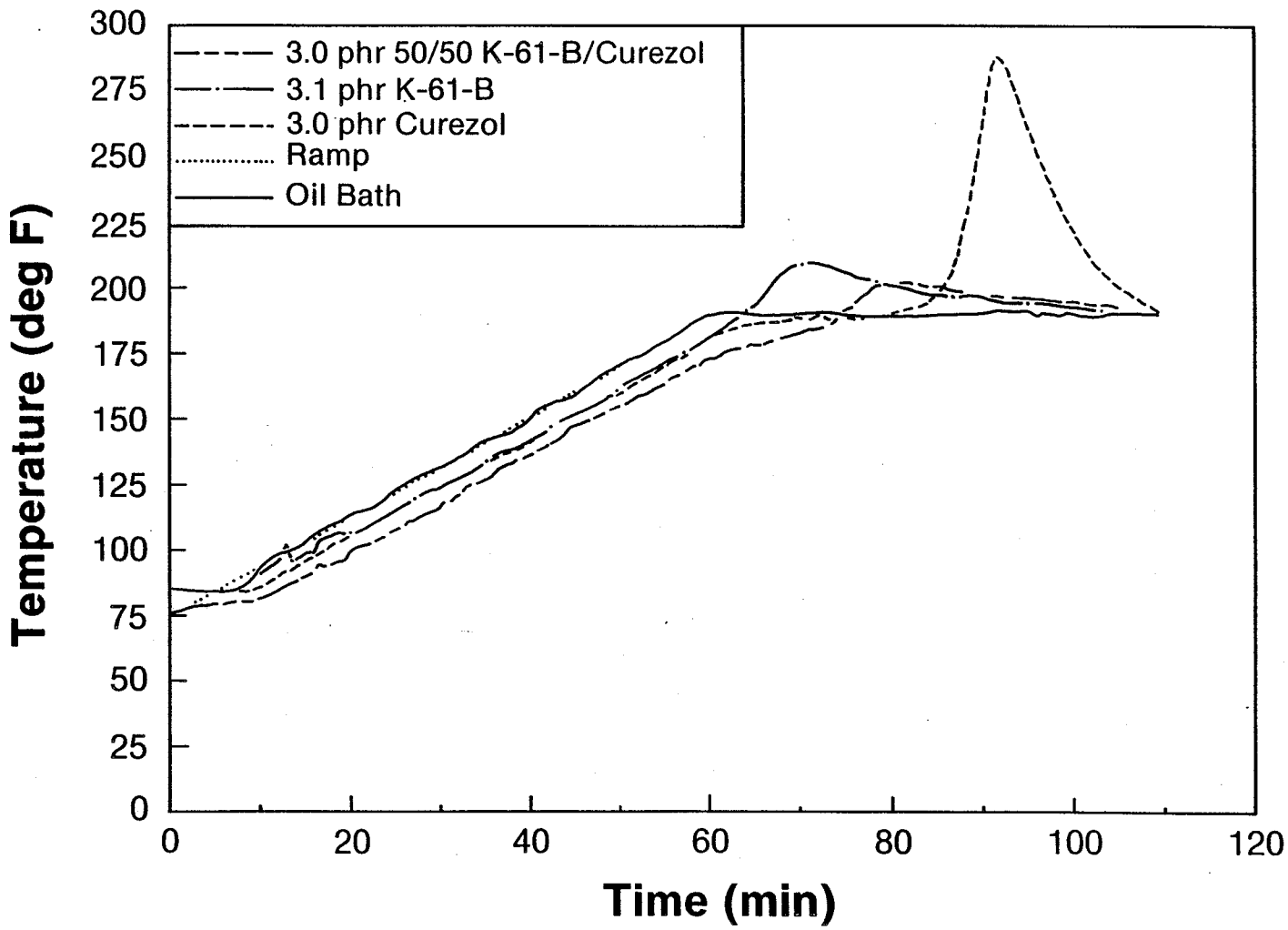
FIGS. 4 and 5 are graphs of temperature increases with time for various combinations of hardeners and epoxy materials.
Figure 5:
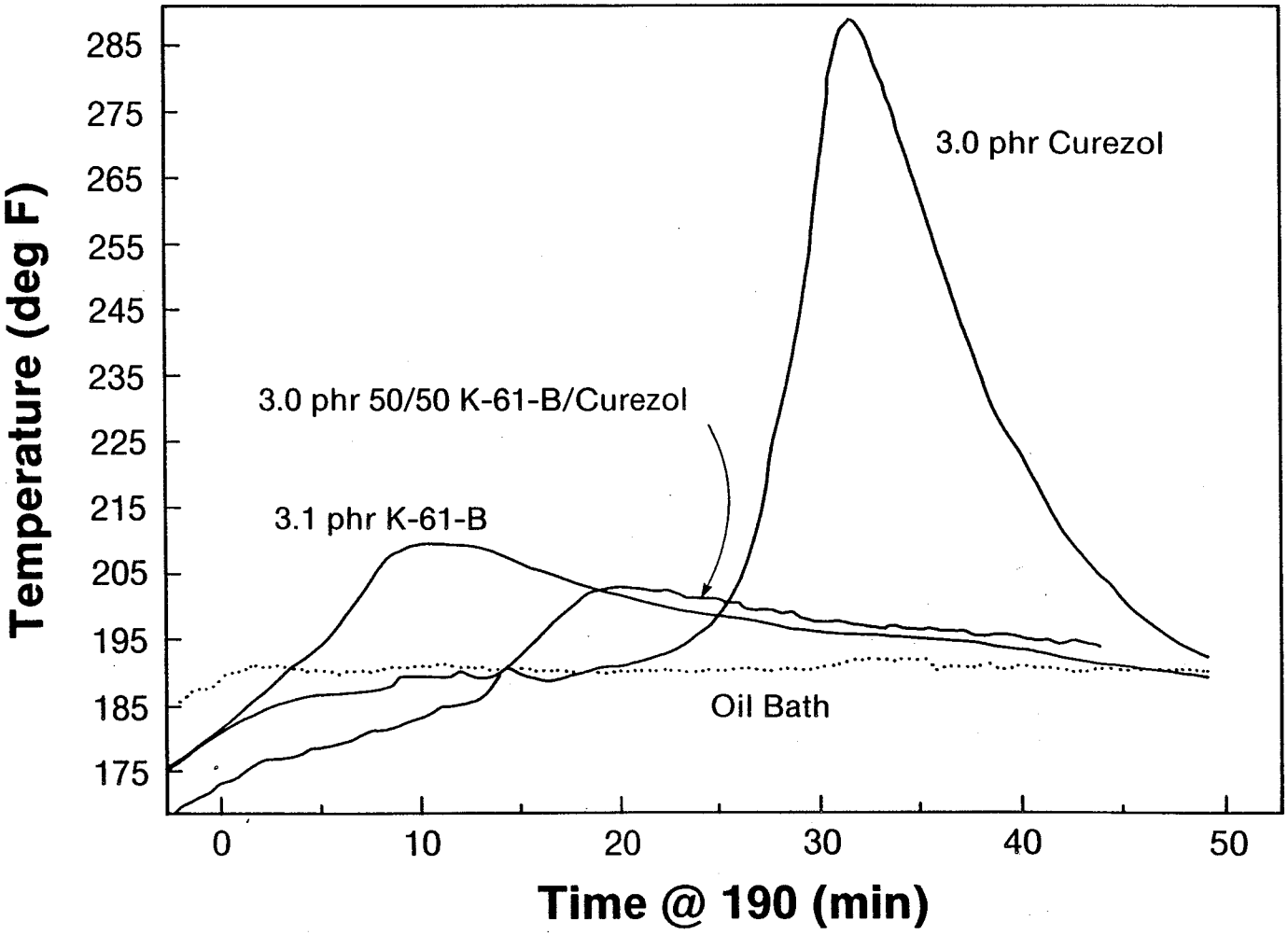

Flow and set time data from the tests are smmarized in Tables 1 and 2. The temperature increases associated with hardener initiation and epoxy reaction from several of the tests are shown in FIGS. 4 and 5. It should be noted that the effect of reservoir pressure is to decrease the flow and set times of epoxy formulations when compared to ambient pressure measurements

TABLE 1

SINGLE HARDENER

| Hardener Concentration (phr)[1] | Hardener | Flow Time (min) | Set Time (min) |
|---|---|---|---|
| 3.1 | K-61-B | 15[2] | 35 |
| 3.0 | Curezol | 25 | 35 |

[1]phr - Parts by weight hardener per hundred parts by weight of epoxy material.
[2]Time after oil bath reached 190° F.

TABLE 2

DUAL HARDENERS

| Hardener Concentration (phr) | K-61-B/Curezol Ratio (% of Total) | Flow Time (min) | Set Time (min) |
|---|---|---|---|
| 2.75 | 50/50 | 30[1] | 55 |
| 2.75 | 34/66 | 35 | 55 |
| 2.75 | 17/83 | 35 | 50 |
| 3.0 | 50/50 | 25 | 50 |
| 3.0 | 34/66 | 30 | 45 |
| 3.0 | 17/83 | 30 | 40 |

[1]Time after oil bath reached 190° F.

The flow time is define as the time that the epoxy remains as a low vicosity fluid. The set time is defined as the time required for the epoxy to stop flowing. The flow and set times of the individual hardeners are shown in Table 1. Although both samples have the same set time, the Curezol sample had a longer flowing time than the K-61-B sample. The activation temperature of the hardeners is the key to understanding this behavior.

Ancamine K-61-B is activated at temperature ranging from 120° F. to 170° F., and Curezol 2E4MZ-CN is activated at temperatures from 160° F. to 200° F. The activation temperature ranges are large because two different types of calorimeters were used to make the measurements.

In Table 1, the flow time of the K-61-B sample is less than the Curezol sample because the hardener initiates at a lower temperature. This results in a viscosity increase in the epoxy fluid but a delay in the ultimate set time because the hardener concentration is near the lower limit required to completely react with the epoxy. Therefore, the K-61-B hardener would not be a good candidate for some applications because the flow time is so short and there is little flexibility to alter the flow or set times. The Curezol hardener has a better flow time behavior but requires concentrations of hardener that produce an undesirable exothermic temperature profile (as shown in FIG. 2).

Formulations that used combinations of both hardeners produced longer flow times than the single hardener formulations. Different flow properties were achieved by varying the combined hardener concentration and the ratio of the hardeners. Increasing the K-61-B concentrations at a fixed hardener level decreased the flow time by viscosifying the epoxy fluid and increased the set time. In all cases, the formulations produced lower exothermic peaks than the 3.0 phr Curezol formulation.

The temperature increases associated with hardener activation and epoxy material reaction are shown in FIGS. 4 and 5.

FIG. 4 shows the oil bath temperature ramp and the temperature response of three epoxy formulations. FIG. 5 is a more detailed plot of the epoxy temperature responses. The differences in activation temperatures between the K-61-B and the Curezol hardeners are clearly shown. The K-61-B exotherm occurs between 5 or 10 minutes after the oil bath reaches 190° F. The Curezol exotherm was delayed until 30 minutes after the oil bath reached 190° F. However, the temperature rise of the Curezol sample peaked at 290° F., much greater than the K-61-B sample. This temperature rise was measured in a 10-gram sample. In a larger mass, the energy released would have resulted in a much greater temperature rise and ultimately may have thermally decomposed the epoxy material. The dual hardener system had a lower exothermic temperature rise than either of the single hardeners.

EXAMPLE 2

Figure 3:
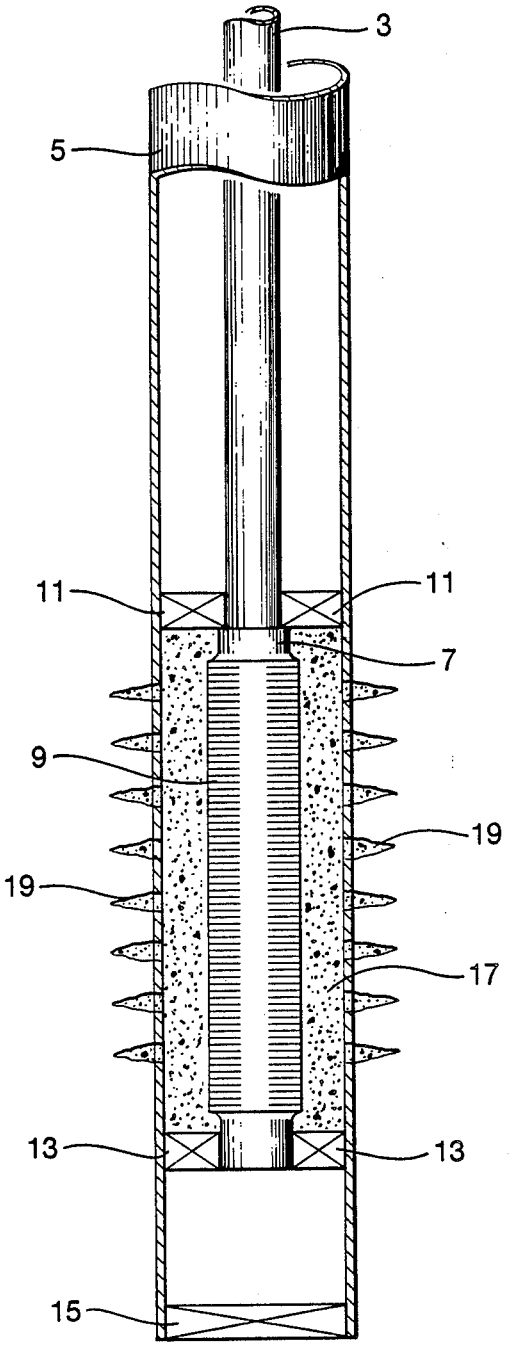
FIG. 3 is a schematic diagram of a wellbore described in conjunction with a field test procedure.

The well shown schematically in FIG. 3 is producing through perforations 19 at 11,948 feet to 11,980 feet. The well has a bottom-hole temperature of 205° F. and a bottom.hole pressure 4400 psi. The last test on the well showed a gas production of 1.2 mmcfd and a water production of 1,000 barrels per day.

Referring to the drawing, 2 $\frac{7}{8}$ inch production tubing (3) is connected in the bottom of the well with slotted tubing (7) which is covered with 124 feet of 4 $\frac{1}{2}$ inch, 6-gauge screen (9). A 7 $\frac{5}{8}$ inch production casing (5) is filled with gravel packing (17) surrounding the lower portion of the production tubing (3) and the screened slotted tubing (7). The extent of the gravel pack (17) is defined by an upper packer (11) around the production tubing and a lower packer (13), which seals the annulus between the wired slotted tubing and the production casing. The production casing (5) below packer (13) is sealed with a lower packer (15).

To seal off the water producing zone. which is in the lower portion of the production interval, the following procedure is followed:

1. A through tubing-bridge plug (not shown) is set at 12,000 feet
2. A 20-foot dump bailer is loaded with cement and is lowered to a position 10 feet above the bridge plug. The dump bailer is then activated to dump the cement, and sufficient time is allowed for the cement to set up.
3. The production tubing (3) is filled with salt water to a fluid level of about 1800 ft to essentially kill the well. It is important that the well remain dormant; therefore, the tubing and casing pressures are monitored before the treatment is carried out to ensure that the well remains relatively static for at least four hours.
4. A 40-foot positive displacement bailer is lowered into the well and loaded from the top with four gallons of Heloxy-69 epoxy material containing 0.90 parts of Ancamine K-61° B hardener and 1.35 parts of Curezol 2E4MZ-CN hardener. each per 100 parts of epoxy material.
5. The dump bailer containing the mixture of epoxy material and hardeners is run into the hole quickly to a position 10 feet above the tubing bridge plug. The dump bailer is then actuated to displace the resin/-hardeners mixture.
6. After the epoxy material/hardeners mixture has had time to completely dump, the bailer is held stationary for several minutes and then pulled very slowly from the well. In order to keep the production tubing liquid full, additional liquid is added while the bailer is being removed to replace the volume occupied by the line attached to the bailer.
7. The epoxy material is allowed to harden for approximately four hours.
8. After cleaning, the bailer is filled with 4 gallons of epoxy material containing the same concentration of hardeners which have been thoroughly mixed.
9. The bailer is again run into the well quickly to a depth of about 30 feet above the tubing bridge plug and dumped again. After allowing time for the bailer to completely dump, one barrel of salt water is slowly pumped into the well.
10. The bailer is again slowly removed from the well with the well being maintained liquid-fluid full by replacing fluid displaced by the line connected to the bailer.
11. The epoxy material is again allowed to harden for approximately four hours.
12. The well is subsequently replaced in operation, and a test is carried out to determine production rates. As a result of the epoxy material treatment, the gas production is now 1.5 mmcfd and the water production is reduced to 100 bpd.

While the invention has been described in its specific application to a gravel-packed well, it is not limited to such use. The placement method disclosed herein may be used to plug any type of zone or formation in a well. In addition, it may be used to plug off other subterranean zones as previously pointed out. Ordinarily, a single epoxy material is used in the process. However, it is within the scope of the invention to use mixtures of different epoxys, particularly as this may be useful in obtaining the desired density difference between the epoxy material and the well fluid. Many of the epoxy materials are viscous at well surface temperatures. To facilitate mixing with the hardeners and introducing the mixture into the bailer, it may be desirable to heat the epoxy material to a temperature above ambient, usually, however, not higher than 110° F. to 120° F.

While certain embodiments and details have been shown for the purpose of illustrating the present invention, it will be apparent to those skilled in the art, that various changes and modifications may be made herein without departing from the spirit or scope of the invention

We claim:

1. A process which comprises:

(a) combining a liquid epoxy material and two hardeners for the epoxy material to form a mixture, the mixture being characterized in that:

(1) each hardener has a different activation temperature;

(2) the amount of each hardener in the mixture is less than that required to totally react with the epoxy material;
(3) the epoxy material has a low viscosity at subsurface conditions of temperature and pressure;
(4) the hardening time of the epoxy material is of short duration at subsurface conditions of temperature and pressure; and
(5) the epoxy material is substantially immiscible with any fluids which are present in the subsurface area;
(b) introducing the mixture into a subsurface area where the epoxy material is to be hardened; and
(c) allowing the epoxy material to harden.

2. A process which comprises:
(a) combining a liquid epoxy material and two hardeners for the epoxy material to form a mixture, the mixture being characterized in that:
(1) each hardener has a different activation temperature;
(2) the amount of each hardener in the mixture is less than that required to totally react with the epoxy material;
(3) the epoxy material has a low viscosity at formation conditions of temperature and pressure;
(4) the epoxy material is substantially immiscible with well fluids; and
(5) the hardening time of the epoxy material is of short duration at formation conditions of temperature and pressure;
(b) introducing the mixture into a well traversing a subterranean formation to a zone where the epoxy material is to be hardened; and
(c) allowing the epoxy material to harden.

3. The process of claim 2 in which the epoxy is used to seal between the wellbore and the formation.

4. The process of claim 2 in which the epoxy is used to plug a zone in the formation.

5. A process which comprises:
(a) mixing an epoxy material and two hardeners for the epoxy material to form a liquid mixture, the mixture being characterized in that:
(1) the epoxy material has a density greater than the density of the well fluid;
(2) the epoxy material has a low viscosity at formation conditions of temperature and pressure;
(3) the epoxy material is immiscible with well fluid;
(4) the mixture of epoxy material and hardeners is essentially free of solids;
(5) the hardening time of the epoxy material is of short duration at formation conditions of temperature and pressure;
(6) each hardener has a different activation temperature; and
(7) the amount of each hardener in the mixture is less than that required to totally react with the epoxy materal;
(b) introducing the mixture into a well traversing a subterranean formation to a point adjacent a zone which is to be plugged;
(c) displacing the mixture into said zone; and
(d) allowing the epoxy material to harden and plug said zone.

6. The process of claim 5 in which the zone to be plugged is in a gravel-packed well.

7. The process of claim 6 in which the mixture is delivered to the point adjacent the zone which is to be plugged in a bailer.

8. The process of claim 7 in which the combined amount of the two hardeners is between about 1 and about 15 parts per 100 parts of epoxy material.

9. The process of claim 8 in which each hardener is present in an amount between about 1 and about 10 parts per 100 parts of the epoxy material.

* * * * *